US008016075B2

(12) United States Patent
Pohl

(10) Patent No.: US 8,016,075 B2
(45) Date of Patent: Sep. 13, 2011

(54) PAINT TRAY

(76) Inventor: Norman R. Pohl, Ancaster (CA)

( * ) Notice: Subject to any disclaimer, the term of this patent is extended or adjusted under 35 U.S.C. 154(b) by 24 days.

(21) Appl. No.: 11/235,133

(22) Filed: Sep. 27, 2005

(65) Prior Publication Data

US 2006/0225959 A1 Oct. 12, 2006

Related U.S. Application Data

(60) Provisional application No. 60/668,592, filed on Apr. 6, 2005.

(51) Int. Cl.
*E06C 5/32* (2006.01)

(52) U.S. Cl. ..... 182/129; 15/257.06; 220/520

(58) Field of Classification Search ..... 182/129; 248/210, 211, 238; 220/570, 736; 15/257.06; D32/53.1

See application file for complete search history.

(56) References Cited

U.S. PATENT DOCUMENTS

| | | | | | |
|---|---|---|---|---|---|
| 3,108,776 | A * | 10/1963 | Cook | 248/210 |
| 3,351,970 | A * | 11/1967 | Engh | 15/257.06 |
| 3,642,240 | A * | 2/1972 | Hershey | 248/210 |
| 3,707,242 | A * | 12/1972 | Golden et al. | 220/570 |
| 4,071,214 | A * | 1/1978 | Reidy | 248/211 |
| 4,205,411 | A * | 6/1980 | Cupp et al. | 15/257.06 |
| 5,024,337 | A * | 6/1991 | Bailey | 211/88.01 |
| 5,079,795 | A * | 1/1992 | Schmid | 15/257.06 |
| 5,201,439 | A * | 4/1993 | Davies | 220/735 |
| D371,876 | S * | 7/1996 | Albert et al. | D32/53.1 |
| 6,076,225 | A * | 6/2000 | Sorenson | 15/257.06 |
| 6,273,289 | B1 * | 8/2001 | Bowman | 220/570 |
| 6,419,106 | B1 * | 7/2002 | Bebak | 220/570 |
| 6,622,340 | B2 | 9/2003 | Rosa | |
| 6,907,640 | B2 * | 6/2005 | Rougeau | 15/257.06 |
| 7,077,238 | B2 * | 7/2006 | Butler et al. | 182/129 |
| 2002/0005409 | A1 * | 1/2002 | Rosa | 220/570 |

FOREIGN PATENT DOCUMENTS

GB 2193486 A * 2/1988

OTHER PUBLICATIONS

Walter Williams, "Walter Williams Book of Inventions", pp. 117-118, Jun. 2001.

* cited by examiner

*Primary Examiner* — Alvin C Chin-Shue
(74) *Attorney, Agent, or Firm* — Steven M. Greenberg; Carey, Rodriguez, Greenberg & O'Keefe, LLP

(57) ABSTRACT

A paint tray has side walls with hook-shaped extensions which are engageable with a rung of a ladder to enable the paint tray to be hung therefrom. The side walls also have wall-like extensions adjacent the opposite end. The base has an extension extending between the wall-like extensions and having a reversely bent portion to form a paint reservoir when the paint tray is upright. The wall-like extensions have hook-shaped portions adjacent the upper front edge of the paint reservoir which are engageable with a rung of a ladder with the paint reservoir behind the rung when the hook-shaped extensions are engaged with a higher rung.

4 Claims, 4 Drawing Sheets

PAINT TRAY

RELATED APPLICATION

This invention claims priority from U.S. Provisional Patent Application No. 60/668,592 filed Apr. 6, 2005.

FIELD OF INVENTION

This invention relates to paint trays.

BACKGROUND OF INVENTION

It is very easy to spill paint from a conventional paint tray when moving it from one place to another. Also, it is very difficult to use a conventional paint tray when painting a surface which requires the use of a ladder. A multi-positioned paint tray has been disclosed in U.S. Pat. No. 6,622,340 (Rosa), but the paint tray disclosed is difficult and awkward to use.

It is therefore an object of this invention to provide an improved paint tray from which spilling is less likely and which can be easily used when the painter is on a ladder.

SUMMARY OF INVENTION

According to the invention, a paint tray has a substantially planar base over which a paint roller can be rolled and a pair of sidewalls on opposite sides of the base. The sidewalls have hook-shaped extensions adjacent one end which are capable of engagement with a rung of a ladder to enable the paint tray to be hung therefrom. The sidewalls also have wall-like extensions adjacent the opposite end, the base having an extension extending between the wall-like extensions and having a reversely bent portion to form a paint reservoir when the paint tray is oriented with the planar base in a substantially upright position. The wall-like extensions have hook-shaped portions adjacent the upper front edge of the reservoir which are engageable with a rung of a ladder with the paint reservoir behind the rung when the hook-shaped extensions are engaged with a higher rung. The hook-shaped extensions and the wall-like extensions are operable to function as supports when the tray is located on a substantially horizontal surface with the planar base substantially level.

The wall-like extensions may also be operable to function as supports when the tray is located on a substantially horizontal surface and the planar base is substantially upright.

The tray may have an upper transverse wall extending across the base at said one end, the upper transverse wall having a notch to receive a portion of a paint roller to enable the paint roller to be mounted on the paint tray with a roller member of the paint tray engaging the base between the side walls.

DESCRIPTION OF THE DRAWINGS

Embodiments of the invention will now be described, by way of example, with reference to the accompanying drawings, of which.

DESCRIPTION OF PREFERRED EMBODIMENT

Figure 1:
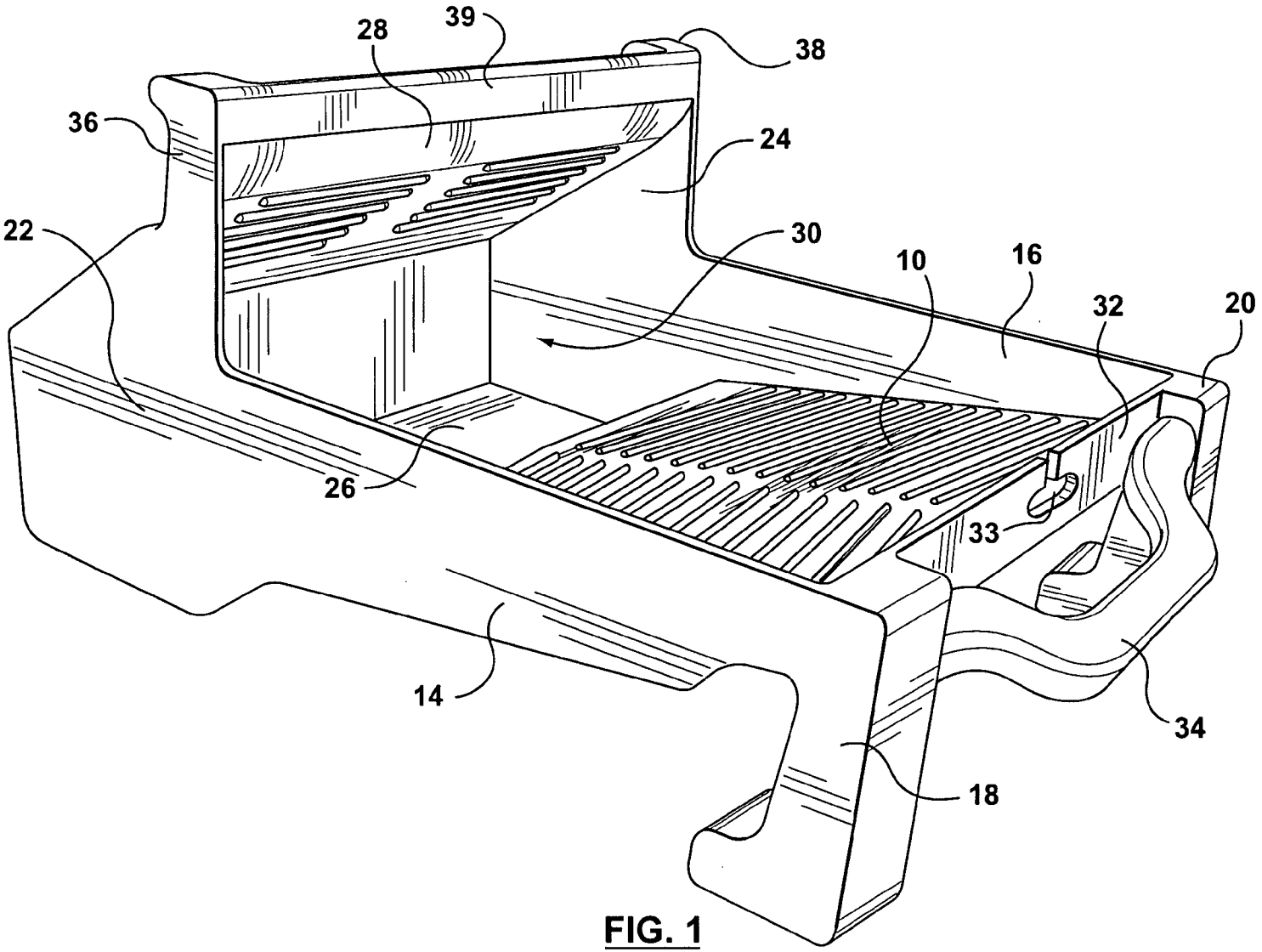
FIG. 1 is a perspective view of a paint tray in accordance with one embodiment of the invention and with its planar base in a substantially level (but slightly inclined) orientation.

Referring to the drawings, a paint tray formed from plastic material has a substantially planar base 10 over which a paint roller 12 can be rolled and a pair of side walls 14, 16 on opposite sides of the base 10. The side walls 14, 16 have hook-shaped extensions 18, 20 adjacent one end and have wall-like extensions 22, 24 adjacent the opposite end. The base 10 has an extension 26 extending between the wall-like extensions 22, 24 and having a reversely bent portion 28 to form a paint reservoir 30.

The planar base 10 has an end wall 32 adjacent the hook-shaped extensions 18, 20 and having a carrying handle 34. The wall-like extensions 22, 24 have hook-shaped portions 36, 38 adjacent the upper front edge of the reservoir 30, and the reversely bent portion 28 has an end portion 39 extending between the hook-shaped portions 36, 38.

FIG. 1 shows the paint tray in an orientation with the planar base 10 substantially level, but with the planar base 10 inclined downwardly towards the reservoir 30. The base 10 is supported in this position by the hook-shaped portions 18, 20 and the wall-like extensions 22, 24. The paint tray can be used like a conventional paint tray, i.e. with paint in the reservoir 30 and the planar base 12 used to roll a paint roller thereon.

Figure 2:
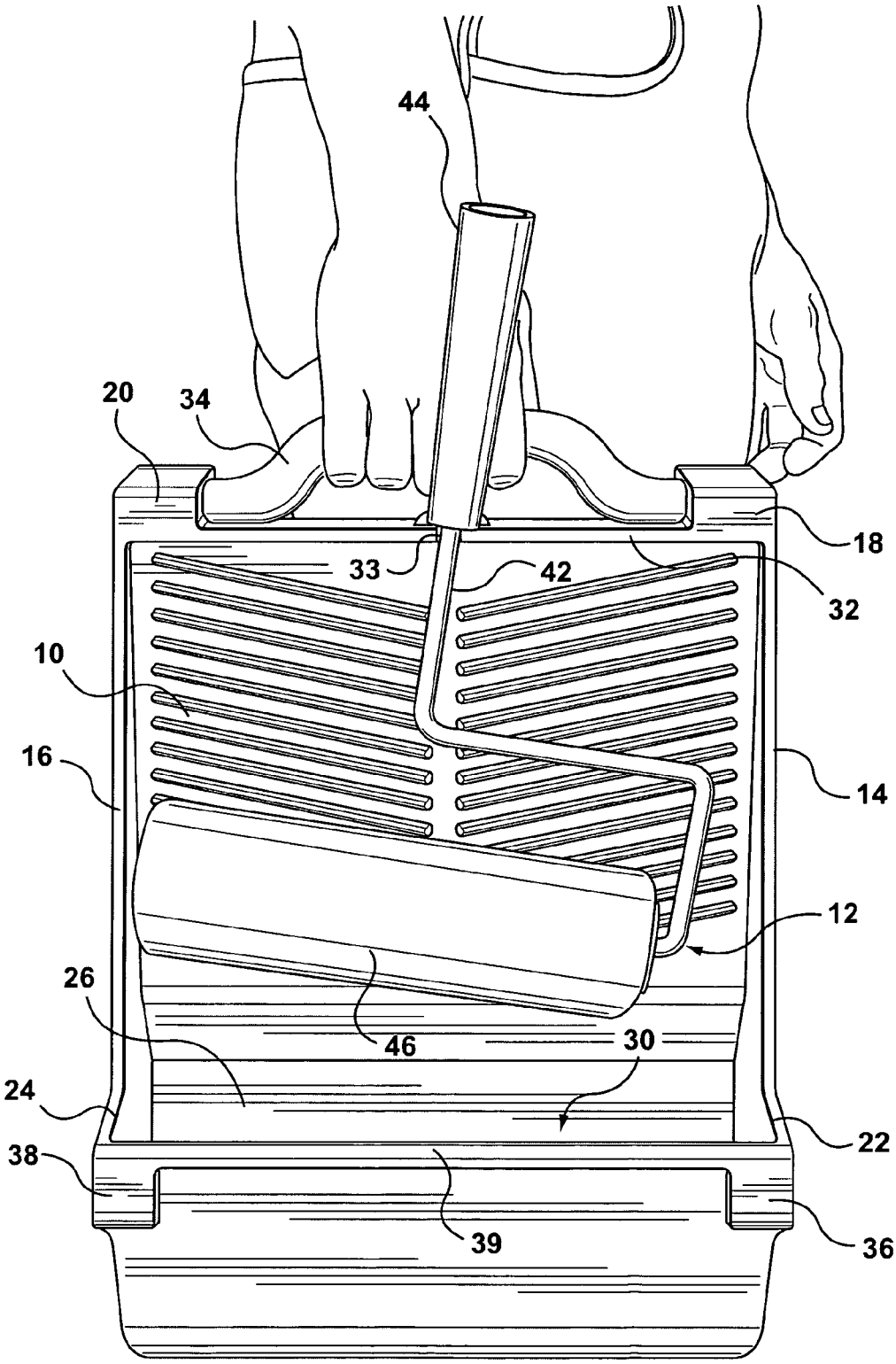
FIG. 2 is a pictorial view showing the paint tray and an attached paint roller being carried.

When it is desired to move the paint tray from one location to another, a painter can grip the carrying handle 34 (as shown in FIG. 2) to carry the paint tray with the base 12 in a substantially upright orientation and with the reservoir 30 functioning in a bucket-like manner. It will be readily understood that the likelihood of spilling paint from the reservoir 30 when the paint tray is in this orientation is minimal. It will also be noted that, in this orientation, the paint tray can be placed on a horizontal surface with the wall-like extensions 22, 24 with the bottom of the reservoir 30 maintaining the tray in this orientation.

The end wall 32 has a slot 33 in which the paint roller 12 can be mounted, as shown in FIG. 2, with the portion of the roller frame 42 just below the handle 44 being located in the slot 33 so that the roller member 36 is adjacent the base 10 just above the reservoir 30.

Figure 3:
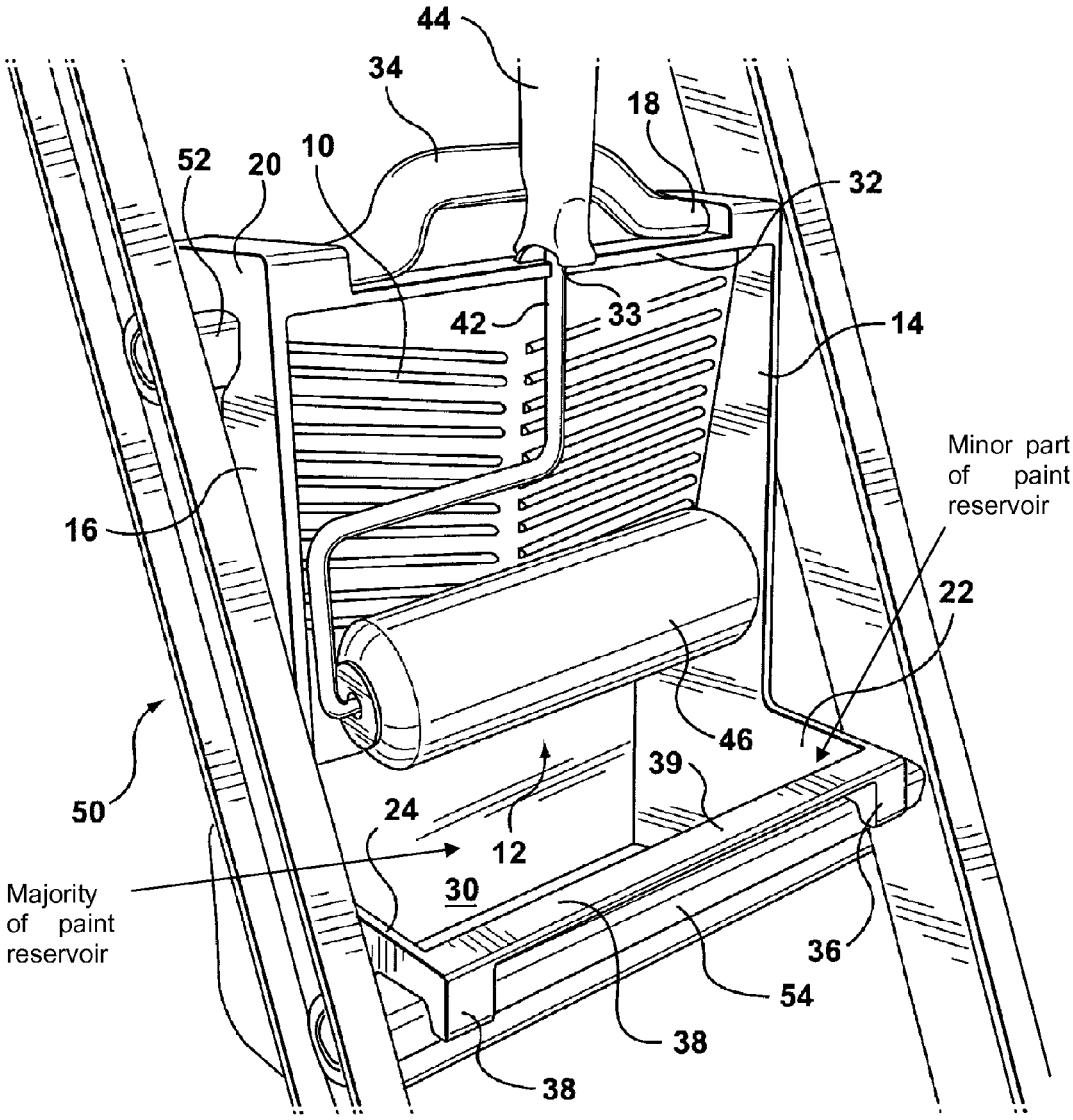
FIG. 3 is a perspective view showing the paint tray (with attached paint roller) mounted on a ladder with the planar base in a substantially upright orientation.
Figure 4:
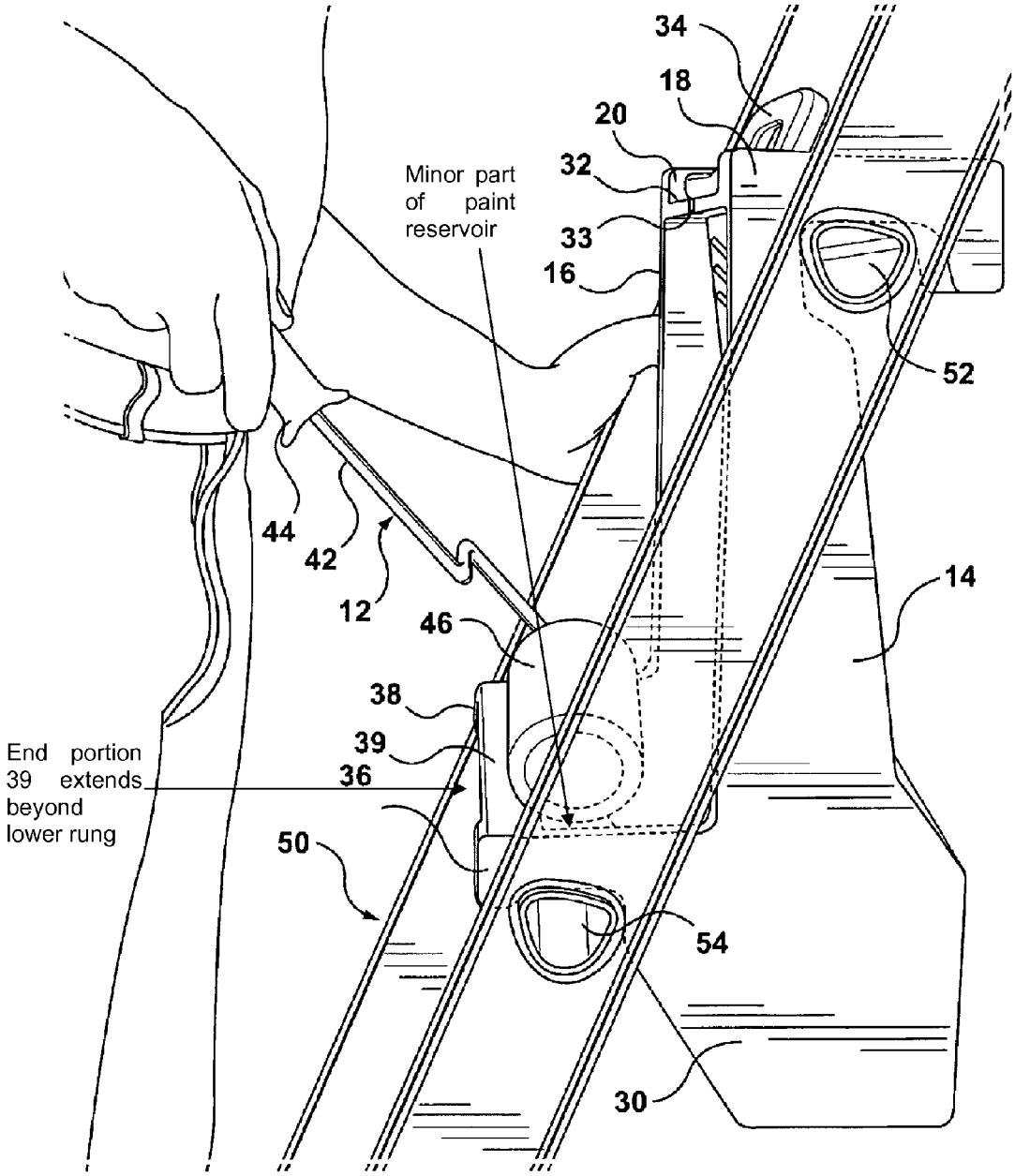
FIG. 4 is a similar view showing the paint roller being used by a painter standing on the ladder.
Figure 3:
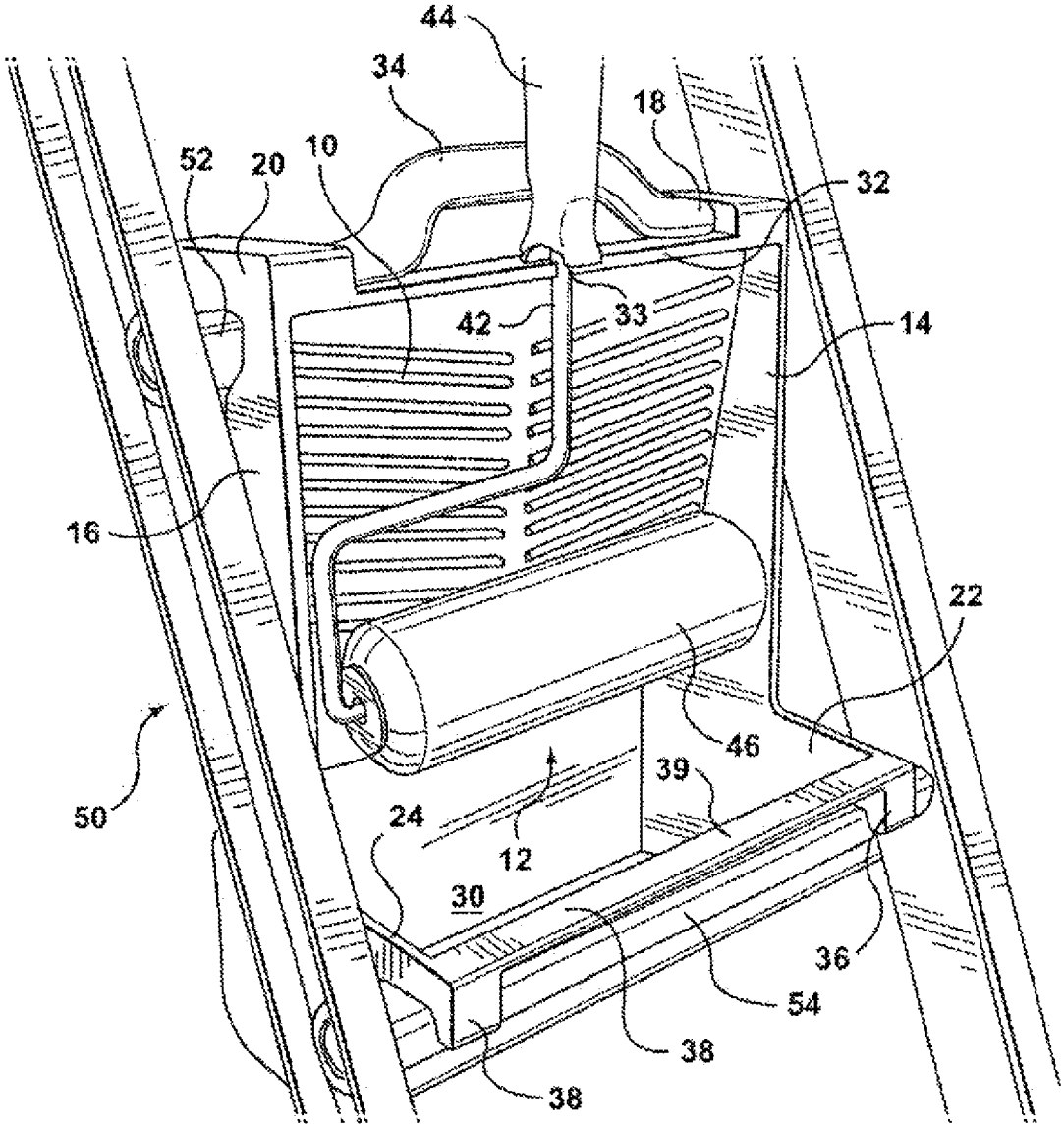
Figure 4:
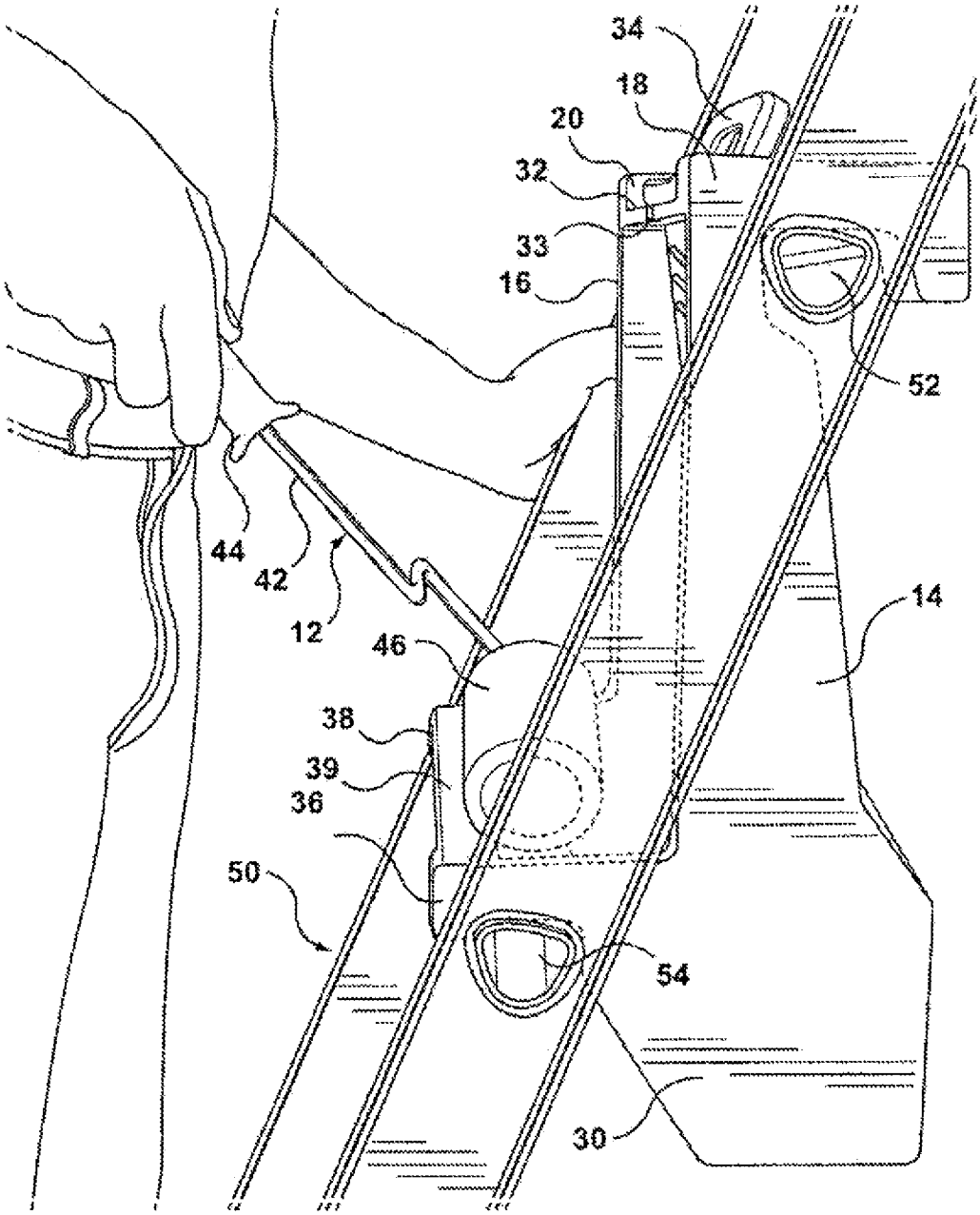

FIG. 3 illustrates the tray mounted on a ladder 50. The hook-shaped extensions 18, 20 can be engaged with an upper rung 52 of a ladder 50 and a hook-shaped portion 36, 38 can be engaged with a lower rung 54. In this position, a painter on the ladder can use the paint tray in a normal manner, as shown in FIG. 4. As can be seen in FIGS. 3 and 4, the reversely bent portion 28 includes an outwardly extending lip which extends over top of and beyond the lower rung 54. As again will be readily apparent, likelihood of paint being spilled from the reservoir 30 is minimal. It will also be noted that most of the paint tray, including the reservoir 30, is located behind the ladder 50, i.e. does not project from the front of the ladder to cause an obstacle which might interfere with the work of the painter.

Other advantages and embodiments of the invention will now be readily apparent to a person skilled in the art from the foregoing description.

The invention claimed is:

1. A paint tray and ladder assembly including a ladder having a plurality of rungs spaced along a length thereof, and a paint tray having:

a first end and a second end;

a substantially planar base adjacent the first end and over which a paint roller can be rolled;

a pair of side walls on opposite sides of the base;

a first set of hooks adjacent the first end;

the first set of hooks being removably engaged with an upper rung of the ladder so that the paint tray is hung therefrom;

the side walls having wall extensions extending toward the second end;

the base having a base extension extending toward the second end, the base extension having a reversely bent portion extending toward the first end;

the wall extensions and the base extension cooperating to form a paint reservoir;

the reversely bent portion including an outwardly extending end portion which extends over top of and beyond a lower rung;

a second set of hooks adjacent an upper front edge of the paint reservoir;

the second set of hooks depending downwardly from the outwardly extending end portion;

the second set of hooks being removably engaged with the lower rung of the ladder with a majority of the paint reservoir behind the lower rung; and a minor part of the paint reservoir defined by the outwardly extending end portion extending over the lower rung.

2. The paint tray and ladder assembly of claim 1 wherein the first set of hooks and the wall extensions are operable to function as supports when the paint tray is removed from the ladder and is located on a substantially horizontal surface with the base in a substantially horizontal position.

3. The paint tray and ladder assembly of claim 2 wherein the wall extensions are operable to function as supports when the paint tray is removed from the ladder and is located on a substantially horizontal surface with the base in a substantially upright position.

4. The paint tray and ladder assembly of claim 3 wherein an upper transverse wall extends across the base of the paint tray at the first end, the upper transverse wall having a notch defined therein to receive a portion of a paint roller to enable the paint roller to be mounted on the paint tray with a roller member of the paint roller engaging the base between the side walls.

* * * * *

UNITED STATES PATENT AND TRADEMARK OFFICE

CERTIFICATE OF CORRECTION

PATENT NO. : 8,016,075 B2
APPLICATION NO. : 11/235133
DATED : September 13, 2011
INVENTOR(S) : Norman R. Pohl It is certified that error appears in the above-identified patent and that said Letters Patent is hereby corrected as shown below:

The title page showing the illustrative figure should be deleted and replaced with the attached title page.

In the drawings, sheet 3 of 4 of Fig. 3 should be replaced with the attached replacement sheet 3 of 4 of Fig. 3 and sheet 4 of 4 of Fig. 4 should be replaced with the attached replacement sheet 4 of 4 of Fig. 4.

Signed and Sealed this
Tenth Day of April, 2012

David J. Kappos

David J. Kappos
*Director of the United States Patent and Trademark Office*

(12) United States Patent
Pohl

(10) Patent No.: US 8,016,075 B2
(45) Date of Patent: Sep. 13, 2011

(54) PAINT TRAY

(76) Inventor: Norman R. Pohl, Ancaster (CA)

( * ) Notice: Subject to any disclaimer, the term of this patent is extended or adjusted under 35 U.S.C. 154(b) by 24 days.

(21) Appl. No.: 11/235,133

(22) Filed: Sep. 27, 2005

(65) Prior Publication Data

US 2006/0225959 A1 Oct. 12, 2006

Related U.S. Application Data

(60) Provisional application No. 60/668,592, filed on Apr. 6, 2005.

(51) Int. Cl.
*E06C 5/32* (2006.01)

(52) U.S. Cl. ..... 182/129; 15/257.06; 220/520

(58) Field of Classification Search ..... 182/129; 248/210, 211, 238; 220/570, 736; 15/257.06; D32/53.1

See application file for complete search history.

(56) References Cited

U.S. PATENT DOCUMENTS

| | | | | |
|---|---|---|---|---|
| 3,108,776 | A * | 10/1963 | Cook | 248/210 |
| 3,351,970 | A * | 11/1967 | Engh | 15/257.06 |
| 3,642,240 | A * | 2/1972 | Hershey | 248/210 |
| 3,707,242 | A * | 12/1972 | Golden et al. | 220/570 |
| 4,071,214 | A * | 1/1978 | Reidy | 248/211 |
| 4,205,411 | A * | 6/1980 | Cupp et al. | 15/257.06 |
| 5,024,337 | A * | 6/1991 | Bailey | 211/88.01 |
| 5,079,795 | A * | 1/1992 | Schmid | 15/257.06 |
| 5,201,439 | A * | 4/1993 | Davies | 220/735 |
| D371,876 | S * | 7/1996 | Albert et al. | D32/53.1 |
| 6,076,225 | A * | 6/2000 | Sorenson | 15/257.06 |
| 6,273,289 | B1 * | 8/2001 | Bowman | 220/570 |
| 6,419,106 | B1 * | 7/2002 | Bebak | 220/570 |
| 6,622,340 | B2 | 9/2003 | Rosa | |
| 6,907,640 | B2 * | 6/2005 | Rougeau | 15/257.06 |
| 7,077,238 | B2 * | 7/2006 | Butler et al. | 182/129 |
| 2002/0005409 | A1 * | 1/2002 | Rosa | 220/570 |

FOREIGN PATENT DOCUMENTS

GB 2193486 A * 2/1988

OTHER PUBLICATIONS

Walter Williams, "Walter Williams Book of Inventions", pp. 117-118, Jun. 2001.

* cited by examiner

*Primary Examiner* — Alvin C Chin-Shue
(74) *Attorney, Agent, or Firm* — Steven M. Greenberg; Carey, Rodriguez, Greenberg & O'Keefe, LLP

(57) ABSTRACT

A paint tray has side walls with hook-shaped extensions which are engageable with a rung of a ladder to enable the paint tray to be hung therefrom. The side walls also have wall-like extensions adjacent the opposite end. The base has an extension extending between the wall-like extensions and having a reversely bent portion to form a paint reservoir when the paint tray is upright. The wall-like extensions have hook-shaped portions adjacent the upper front edge of the paint reservoir which are engageable with a rung of a ladder with the paint reservoir behind the rung when the hook-shaped extensions are engaged with a higher rung.

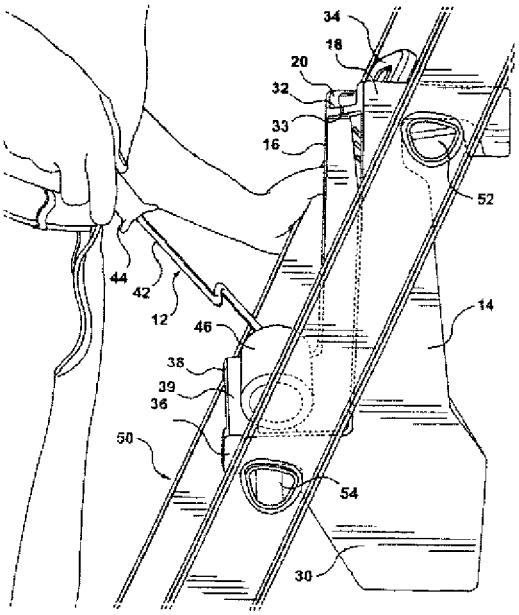

4 Claims, 4 Drawing Sheets